US005088651A

United States Patent [19]

Takahashi et al.

[11] Patent Number: 5,088,651

[45] Date of Patent: Feb. 18, 1992

[54] ROLL CRUSHER AND CRUSHING METHOD IN USE FOR THE ROLL CRUSHER

[75] Inventors: Nobuhiro Takahashi; Fumio Takagi, both of Tokyo, Japan

[73] Assignee: Nittetsu Mining Co., Ltd., Tokyo, Japan

[21] Appl. No.: 590,562

[22] Filed: Sep. 28, 1990

Related U.S. Application Data

[63] Continuation of Ser. No. 364,450, Dec. 5, 1988, abandoned.

[30] Foreign Application Priority Data

Apr. 28, 1987 [JP] Japan ..... 62-103320
Apr. 28, 1987 [JP] Japan ..... 62-103321

[51] Int. Cl.[5] ..... B02C 4/42

[52] U.S. Cl. ..... 241/30; 241/101.2; 241/227

[58] Field of Search ..... 241/101.2, 222, 230, 241/227, 152 A, 235, 30

[56] References Cited

U.S. PATENT DOCUMENTS

| | | | |
|---|---|---|---|
| 198,605 | 12/1877 | Grant et al. | 241/226 |
| 942,865 | 12/1909 | Petersen | 241/226 X |
| 1,014,383 | 1/1912 | Prazee | 241/226 X |
| 2,306,427 | 12/1942 | Christman et al. | 241/226 X |
| 3,497,321 | 2/1970 | Decker et al. . | |
| 4,377,260 | 3/1983 | Huffman . | |
| 4,703,897 | 11/1987 | Beisner et al. | 241/152 A X |
| 4,905,910 | 3/1990 | Wuestner | 241/101.2 |

FOREIGN PATENT DOCUMENTS

| | | |
|---|---|---|
| 7694 | 7/1929 | Japan . |
| 22688 | 12/1958 | Japan . |
| 61547 | 12/1982 | Japan . |
| 160541 | 9/1984 | Japan . |
| 186652 | 10/1984 | Japan . |
| 140946 | 9/1987 | Japan . |

*Primary Examiner*—Mark Rosenbaum
*Attorney, Agent, or Firm*—Jordan and Hamburg

[57] ABSTRACT

A roll crusher having a pair of rolls facing each other, in which feed material to be crushed is fed into a space or a crushing chamber formed in between these rolls, and the pair of rolls rolls up the material to compress and crush it. Both ends of one or the other of the rolls are provided with flanges which cover the lower portions of end openings in the crushing chamber. Cheek plates fixedly disposed cover the remaining portions of the end openings of the crushing chamber. This construction helps prevent feed material from flowing out of the crushing chamber. One of the pair of the rolls is driven for rotation by a source of drive power, and the other is rotated freely as well as driven to rotate initially at low speed, which permits coarse materials to be forcibly entrained in between the rolls for crushing. During the process of crushing, the crushing clearance of rolls is set to 0.6 to 2.4 times 80% passing size of feed material, and feed rate is limited so that passing rate of the material ranges 0.5 to 0.8 times the theoretical throughput capacity of the crusher, which remarkably increases the actual throughput of the roll crusher.

5 Claims, 10 Drawing Sheets

PARTICLE SIZE DISTRIBUTION OF FEED MATERIAL

PARTICLE SIZE DISTRIBUTION OF PRODUCT OBTAINED BY THE INVENTION

PARTICLE SIZE DISTRIBUTION OF PRODUCT OBTAINED BY THE PRIOR ART

PARTICLE SIZE DISTRIBUTION OF PRODUCT OBTAINED BY THE INVENTION

PARTICLE SIZE DISTRIBUTION OF PRODUCT OBTAINED BY THE PRIOR ART

ROLL CRUSHER AND CRUSHING METHOD IN USE FOR THE ROLL CRUSHER

This application is a continuation, of application Ser. No. 364,450, filed Dec. 5, 1988, now abandoned.

TECHINICAL FIELD

The invention relates to a roll crusher for crushing rocks and ores, etc., and to a crushing method used in the roll crusher.

BACKGROUND ART

There has been known a type of roll crusher, as shown in FIGS. 5 and 6, in which a pair of rolls 2 and 3 respectively facing each other and rotating in opposite direction to each other is provided, feed material such as rocks and ores to be crushed is supplied through the supply port 5 into the crushing chamber 6, that is, a space formed in between the pair of rolls, and the feed material supplied is crushed by compression while being rolled with said pair of rolls 2 and 3.

The type of roll crusher has a crushing chamber 6 (a region indicated by chain line) as shown in FIGS. 7*a* and 7*b*, whose longitudinal side faces 6*a* and 6*b* are formed respectively by the outer surfaces of the pair of rolls 2 and 3, and whose end faces 6*c* and 6*d* coincide with the openings formed in between the end faces 2*a* and 2*b* as well as 3*a* and 3*b* of said pair of respective rolls 2 and 3. But the crushing chamber shown is an example for explanation, therefore not necessarily limited to the shape shown, but varying depending on the crushing conditions.

On the other hand, some roll crushers according to the prior art are provided with side plates called cheek plates to prevent crushed stock from flowing out from the end openings 6*c* and 6*d* of the crushing chamber 6. During the process of crushing by the rolls 2 and 3, this type of roll crusher has no capability sufficient to prevent material being crushed from being pushed out of the crushing chamber 6 through the lower end portions of the end openings 6*c* and 6*d* (higher pressure applied on material to be crushed here), thus resulting in higher pressure applied on the rolls 2 and 3 at the roll center, and in lower pressure at both ends.

Repeated crushing with such different pressures distributed on the rollers may cause partial wear of the rolls 2 and 3, as shown in FIG. 8, thus resulting in a uniform shape with the smaller middle section and the larger end sections. Due to such partial wear a constant axial crushing clearance between rolls is not maintained. Therefore, in crushing material with a relatively small clearance in such case as making crushed sand, crushing clearance at the middle section is too large, although the rolls come into a close contact with each other with zero clearance at both ends. This partial wear of rolls has been long well known as the worst defect of the roll crusher, which causes a failure of effective crushing, thus necessitating laborious repair work to abrade the roll surface to restore a uniform axial crushing clearance between rolls.

Heretofore, in crushing rocks or ores by means of a roll crusher, to have a large crushing ratio, roll clearance is adjusted to be equal to or smaller than the particle size of desired products. Particularly for fine particle products, to have a large fraction of fine particles in crushed products, it was common for roll clearance to be adjusted to about ½ particle size of desired products.

Crushing mechanism according to the prior art may be described as follows, referring to FIG. 14. A clearance between a pair of opposing rolls 2 and 3, that is, crushing clearance S is smaller than particle diameter F of feed material to be crushed, and equal to or smaller than the particle diameter P of desired products. Particles of material to be crushed are subjected to a continuously increasing compressive load and are eventually broken from the time when they come into contact with the surfaces of the pair of the opposing rolls to the time when they pass between the closest positions of the two opposing rolls.

As stated above, the roll crusher according to the prior art has a small crushing clearance S, thus limiting the throughput capacity of feed material through the crushing chamber, resulting in a low productivity of products. Especially, the smaller the particle size of desirable products, the smaller the crushing clearance, thus further restricting the productivity.

And, because feed material to be crushed is pressed by the roll 2 and 3 from the left and right sides of the drawing, the size and shape of broken particles are regulated as regards the horizontal direction, but no regulation can be expected as regards other two directions such as vertical and perpendicular to the paper surface of the drawing. Therefore, products according to the prior art include a large fraction of particles having sizes larger than the crushing clearance S, and it is well known that they contain a lot of flat or slender particles.

OBJECTS OF THE INVENTION

The first object of the invention is to provide a uniform longitudinal (axial direction of rolls) pressure distribution in the crushing chamber for a high compression crushing effect and for prevention of partial wear of rolls in the axial direction thereof.

The second object of the invention is to provide a simplified mechanism for driving the rolls for reduced cost.

The third object of the invention is to provide an enhanced productivity in making products, particularly of finer particles, by means of a roll crusher, and a high acceptance factor of products with particles of round shape.

DISCLOSURE OF INVENTION

To achieve the first object of the invention, the invention provides a roll crusher in which a pair of rolls facing each other is provided, feed material is supplied into a space formed in between these two rolls or a crushing chamber, and the feed material to be crushed is compressed for crushing while being rolled up with aforesaid pair of rolls, being characterized by flanges fixed to the end surfaces of either roll for rotation with the roll, having a radius at least a crushing clearance between the rolls larger than that of the roll, and disposed to block end openings of aforesaid crushing chamber, as well as by stationary block members disposed to block an area of the end openings of aforesaid crushing chamber other than the area blocked by aforesaid flanges, and to prevent material to be crushed from flowing out of the end openings of the crushing chamber.

To achieve the second object of the invention, the invention provides a roll crusher in which a pair of rolls facing each other is provided, feed material is supplied into a space formed in between these two rolls or a crushing chamber, and the feed material to be crushed is compressed for crushing while being rolled up with aforesaid pair of rolls, being characterized by one roll of aforesaid pair of rolls or a driver roll being power driven for rotation, and the other roll or a follower roll being rotated freely or at least together with the driver roll through the material rolled up in between the rolls while the material is being crushed.

To achieve the third object of the invention, the invention provides a crushing method by a roll crusher in which a pair of rolls facing each other is provided, feed material is supplied into a space formed in between these two rolls or a crushing chamber, and the feed material to be crushed is compressed for crushing while being rolled up with aforesaid pair of rolls, being characterized by a limited crushing clearance in between the rolls of 0.6 to 2.4 times 80% passing size of the feed material to be crushed, and a limited feed rate in a range of 0.5 to 0.8 times the theoretical throughput of the crusher.

Figure 8:
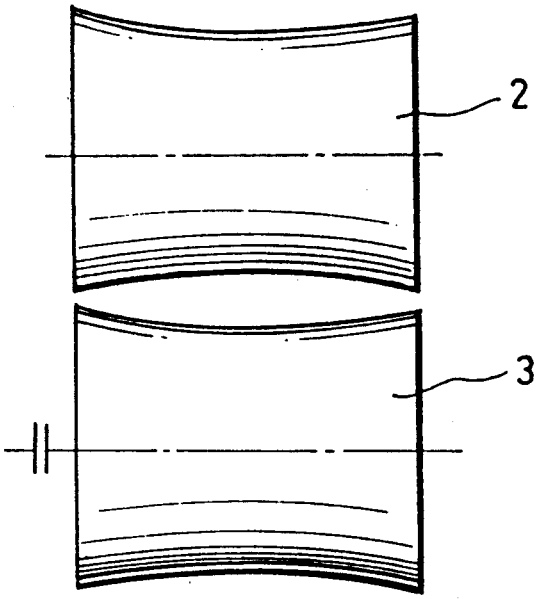
FIG. 8 PRIOR ART
Figure 9:
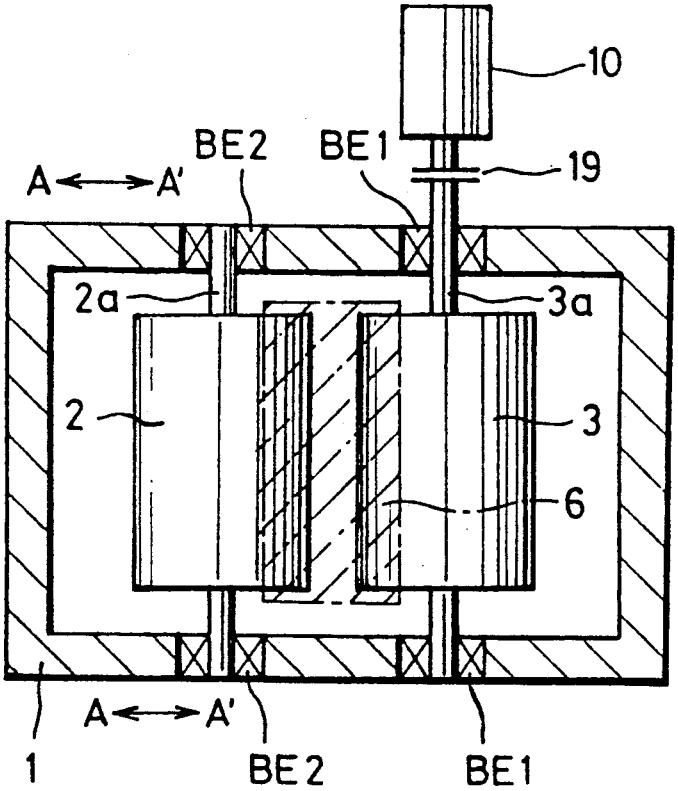
Figure 10:
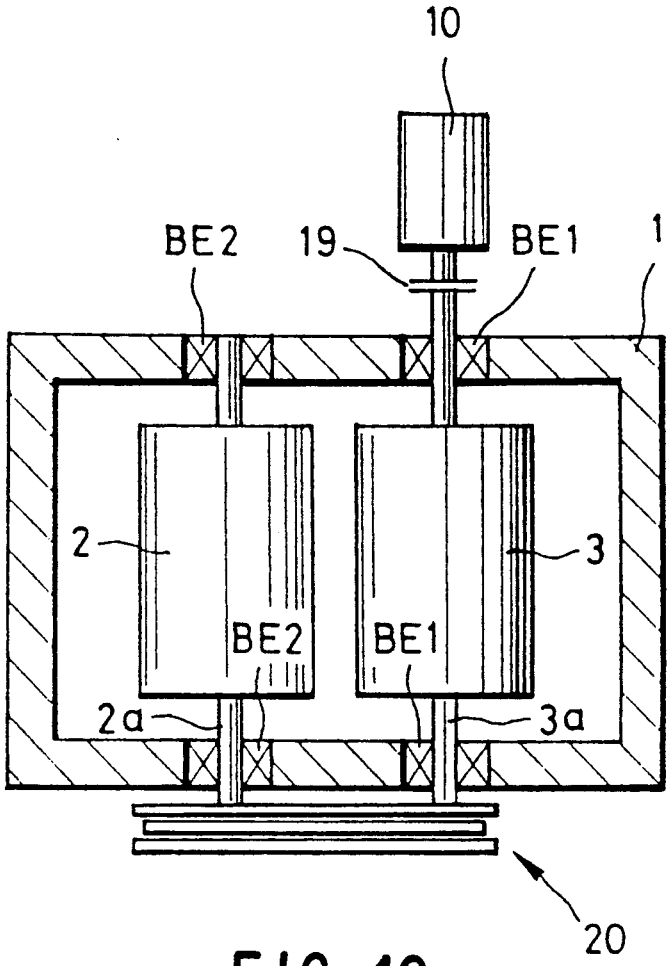
Figure 11:
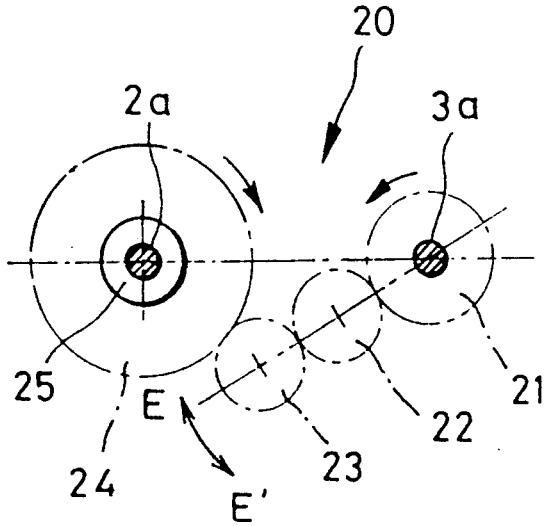
Figure 12:
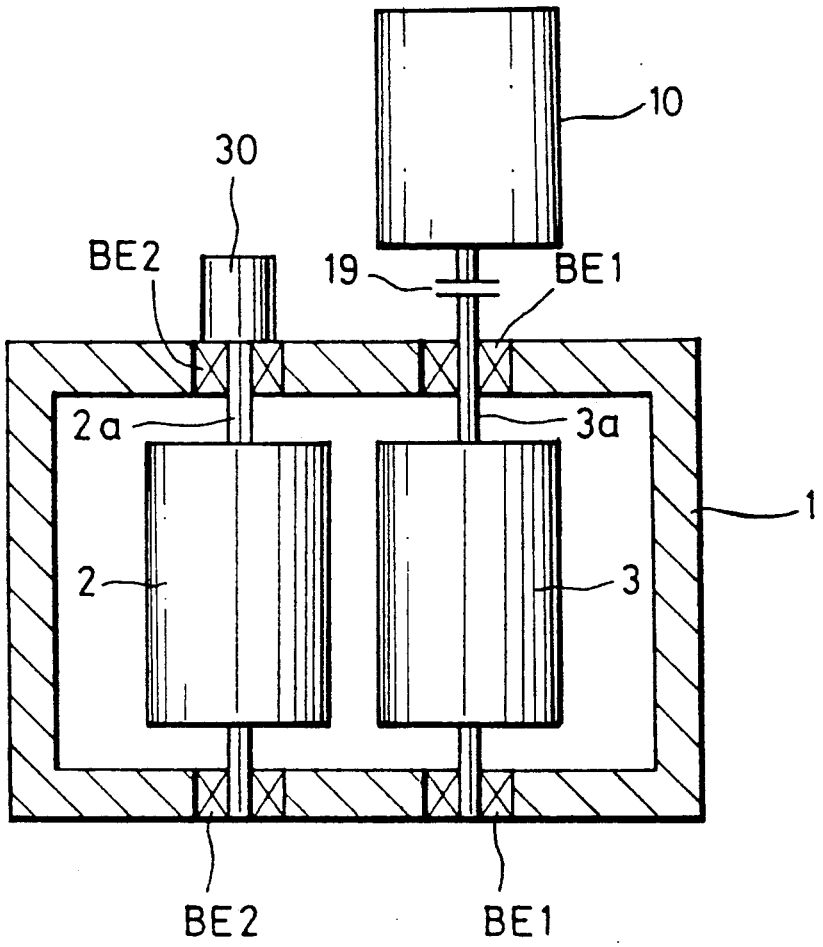
Figure 13:
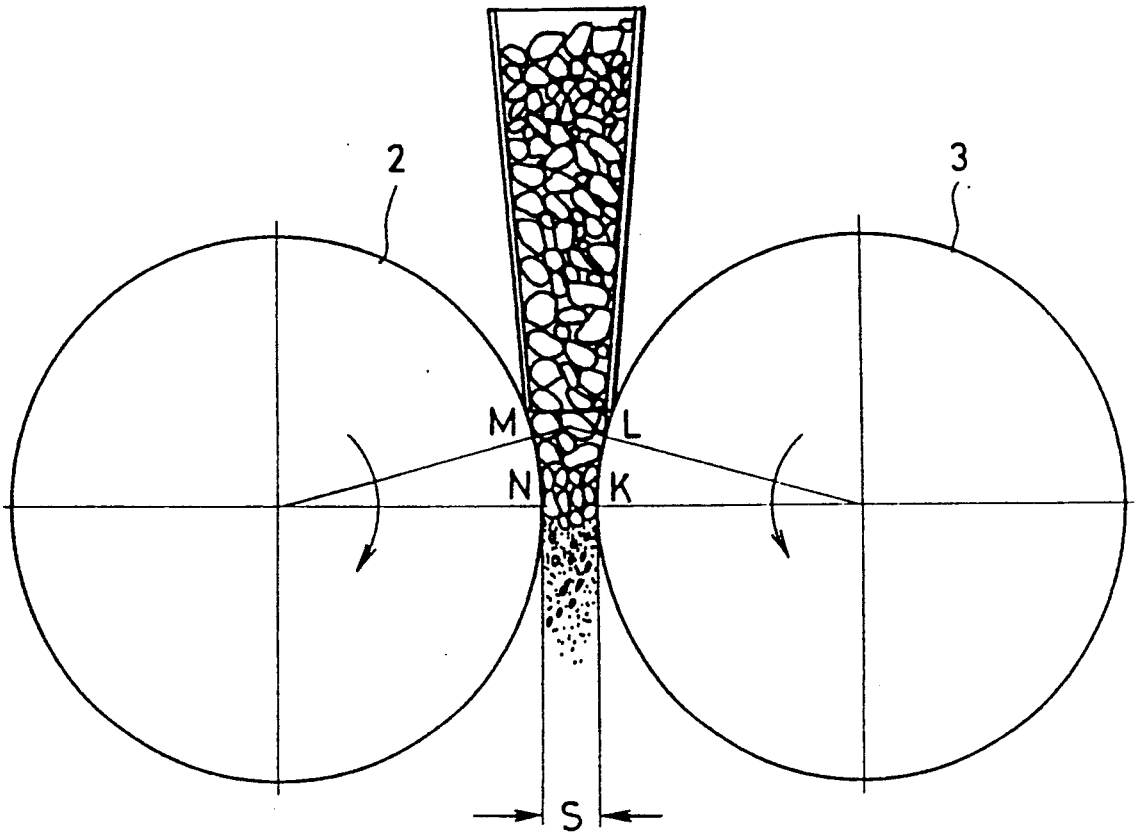
Figure 14:
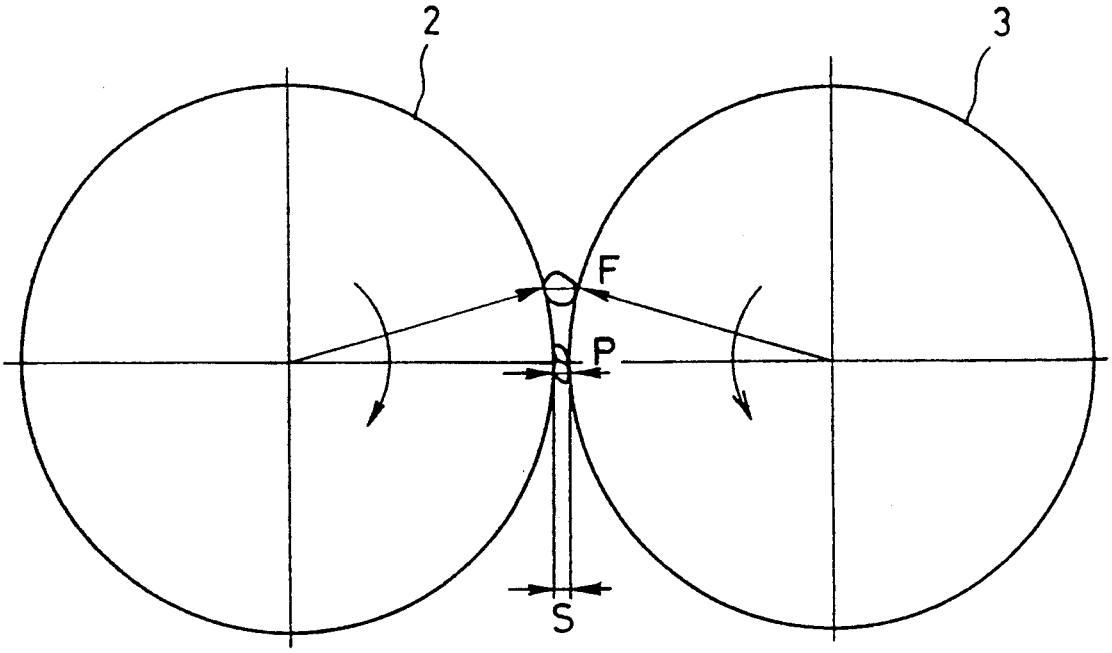
FIG. 14 PRIOR ART
Figure 15:
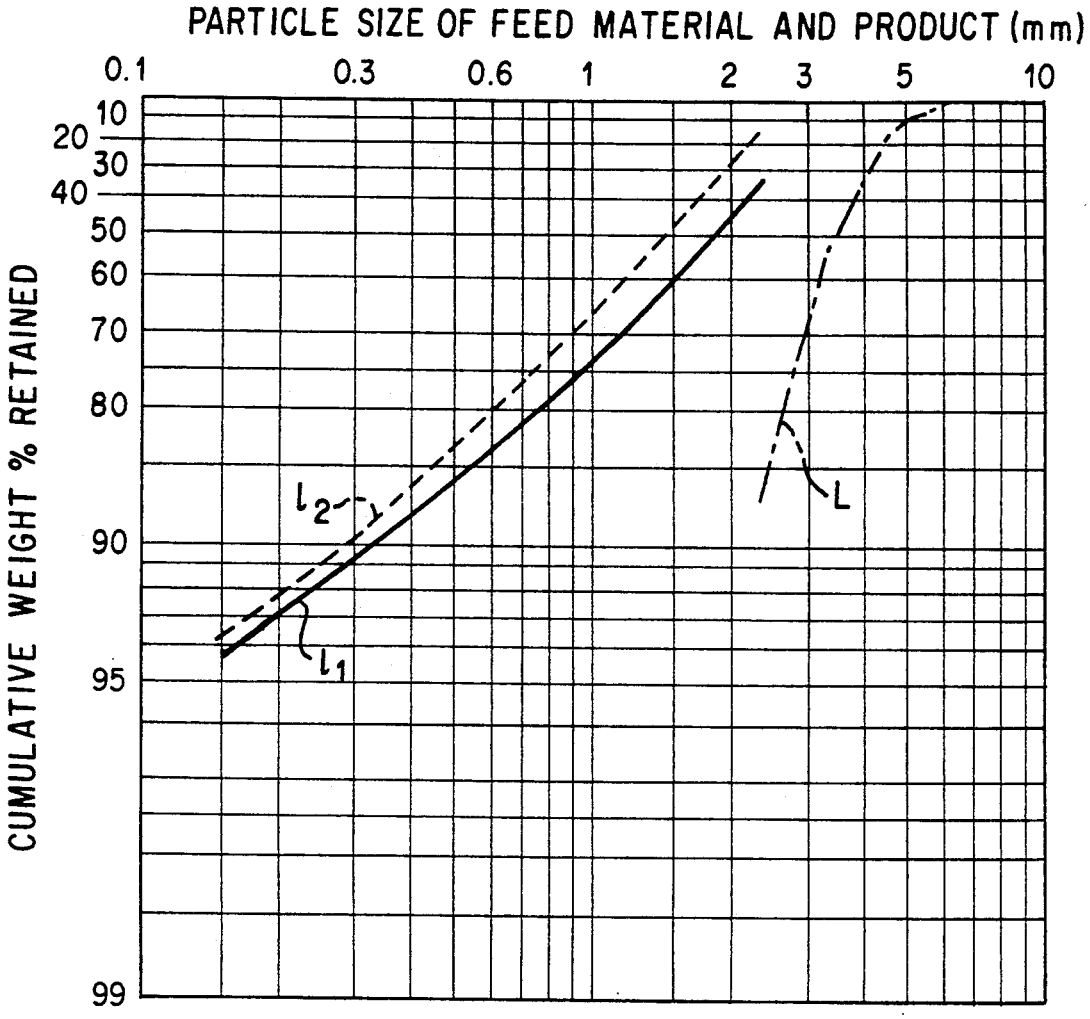
Figure 16:
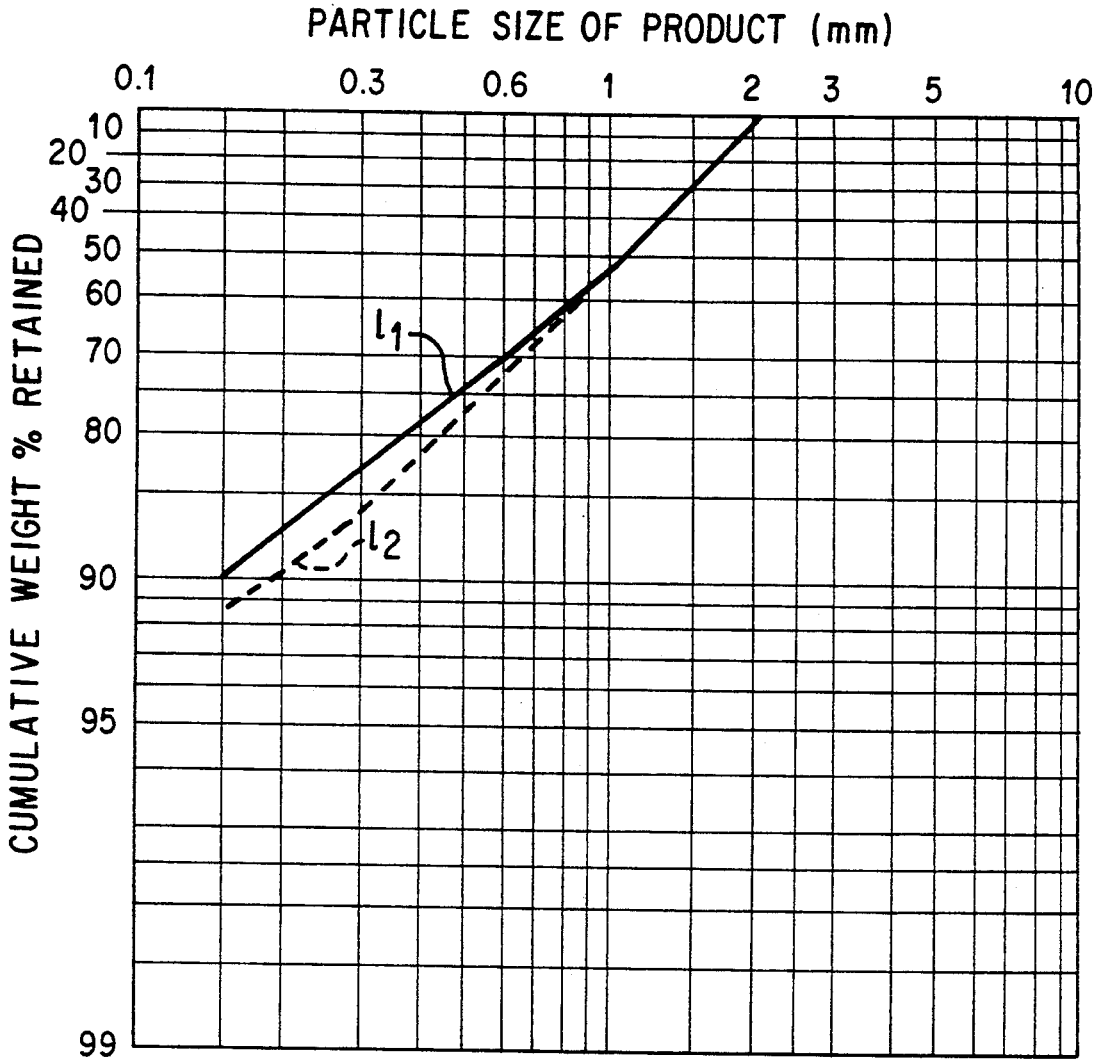

FIGS. *7a* and *7b* are perspective views showing the crushing chamber;

FIG. 8 is a view showing partial wear of rolls in the roll axial direction;

FIG. 9 is a sectional view showing an example of the roll driving device;

FIG. 10 is a sectional view showing another example of the roll driving device;

FIG. 11 is a view showing the gear train for use in the device in FIG. 10;

FIG. 12 is a sectional view showing another example of the roll driving device;

FIG. 13 is a view showing an interparticle crushing method;

FIG. 14 is a view showing the crushing method according to the prior art; and FIGS. 15 and 16 are graphs showing particle size distributions of feed material and crushed products.

BEST MODE FOR CARRYING OUT THE INVENTION

Figure 1:
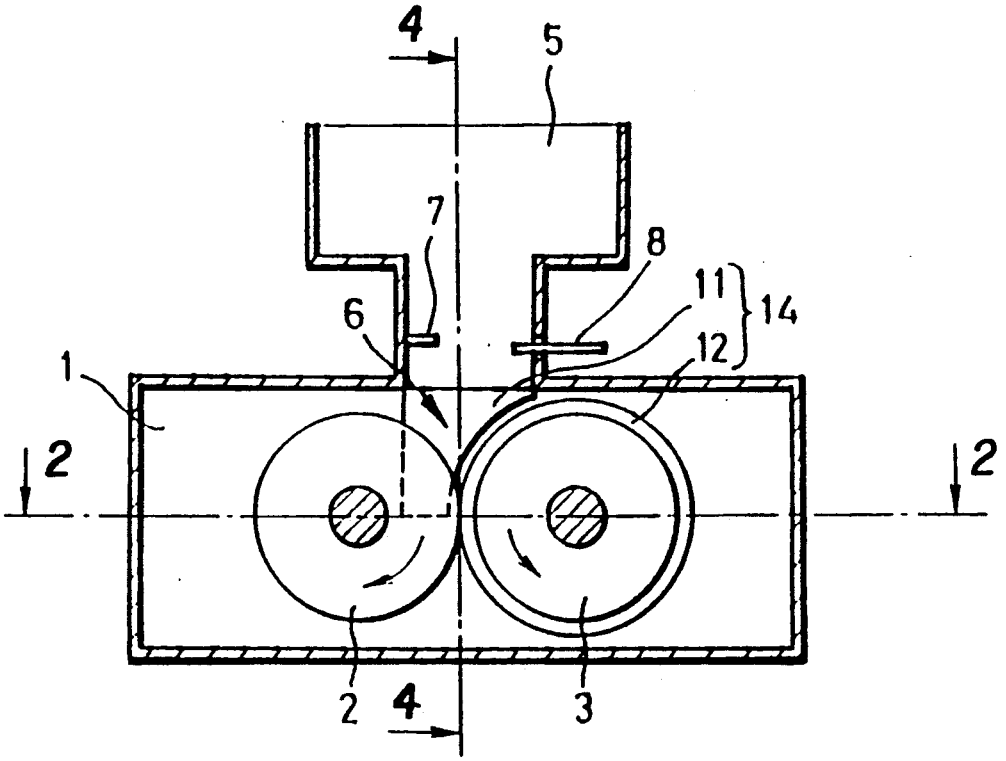
FIG. 1 is a sectional side view of an embodiment according to the invention.
Figure 2:
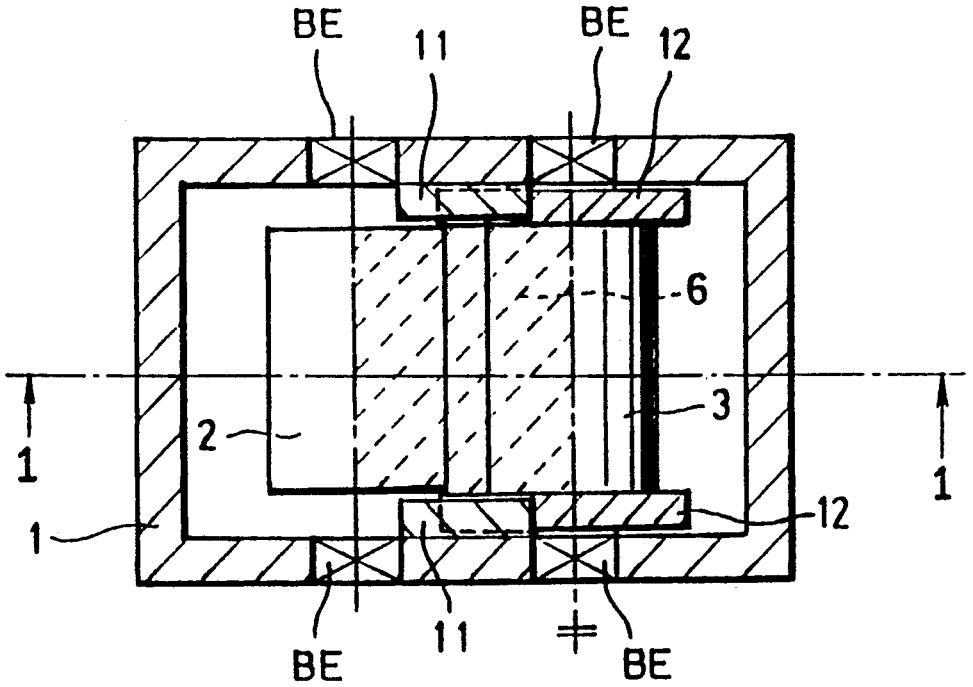
FIG. 2 is a sectional plan view of FIG. 1 taken along line II—II.
Figure 5:
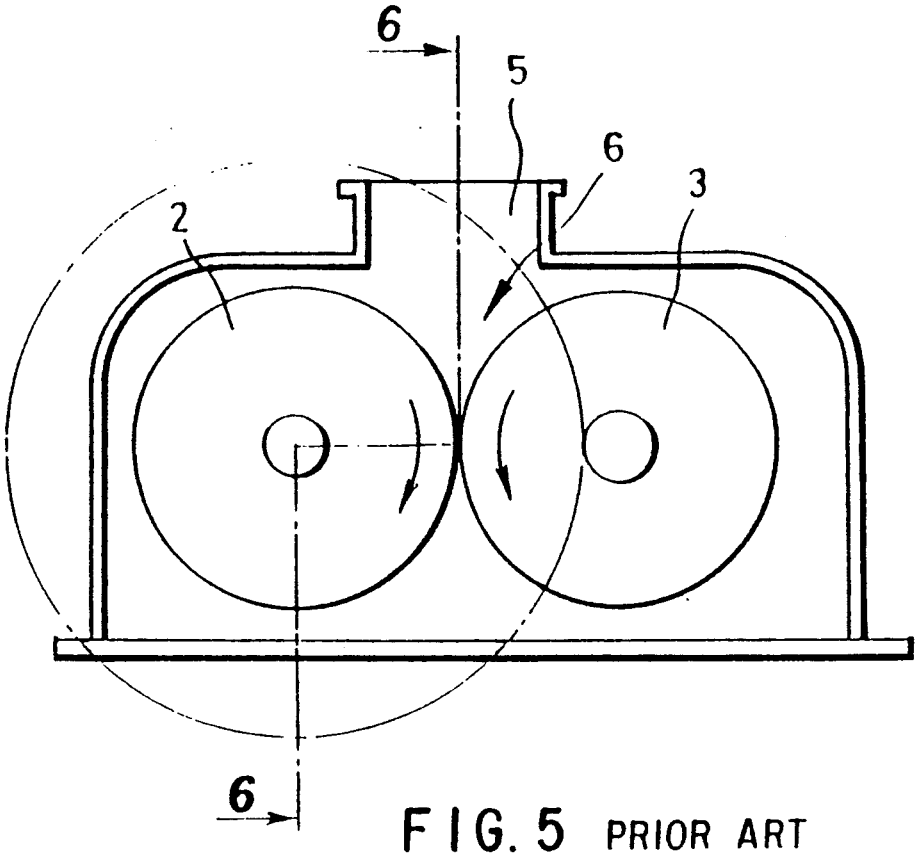
FIG. 5 PRIOR ART
FIGS. 5 and 6 are sectional views of the roll crusher according to the prior art.
Figure 6:
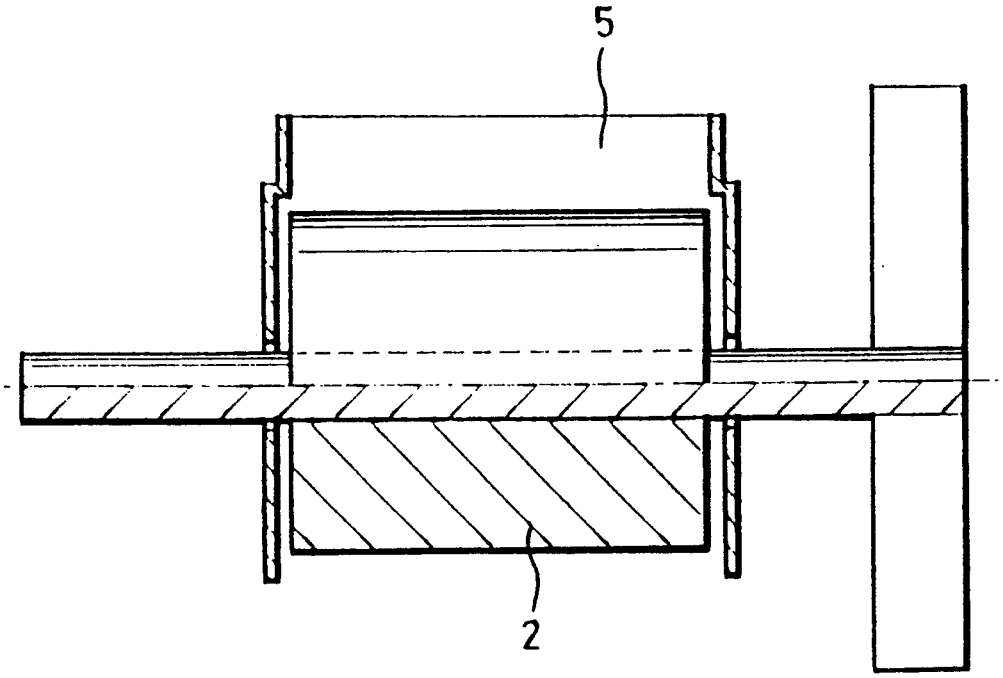
FIG. 6 PRIOR ART
Figure 7A:
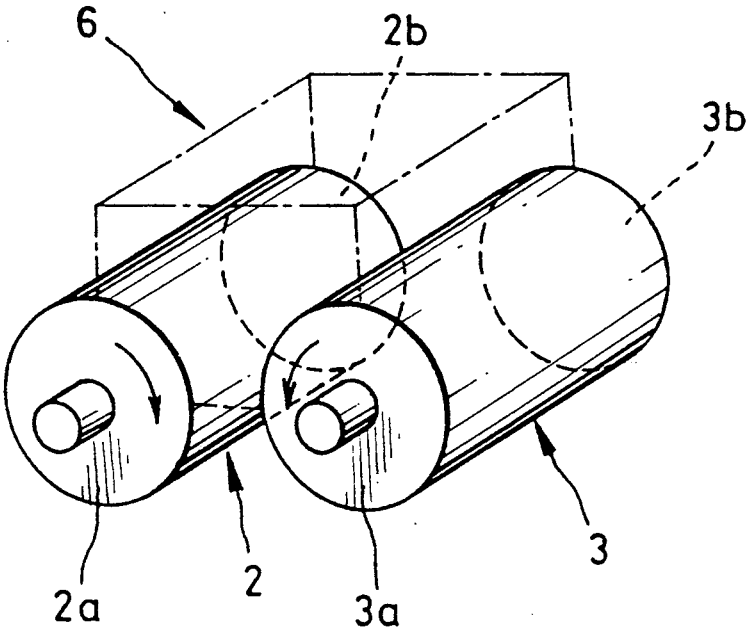
FIG. 7a PRIOR ART
Figure 7B:
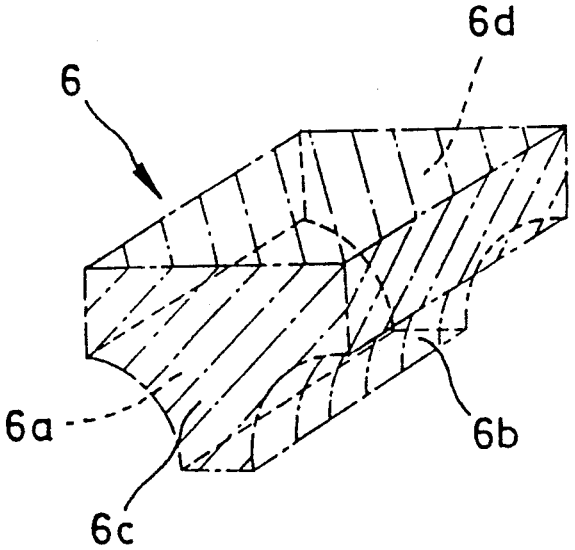
FIG. 7b PRIOR ART

FIGS. 1 and 2 show an example of a roll crusher according to the invention. In these drawings, the same members as the roll crusher according to the prior art shown in FIG. 5 are given by the same numerals. The differences of a roll crusher according to the invention from the roll crusher according to the prior art are: block members or cheek plates 11 which prevent feed material to be crushed from flowing out of a crushing chamber 6 by blocking end surface openings 6*c* and 6*d* in the crushing chamber 6 (FIG. *7b*), and flanges 12 which prevent the feed material to be crushed from being pushed out of the crushing chamber 6 through lower end portions under high pressure applied to the feed material to be crushed in the end surface openings 6*c* and 6*d*. The flanges 12 are fixed to end faces of one roll 3 for rotating together with the roll 3. The radius of the flange 12 is at least a crushing clearance in between the rolls larger than that of the roll 3. Because the flange 12 rotates integrally with the roll 3, there is little relative dislocation thereof to feed material to be compressed and crushed in between the rolls 2 and 3 under high pressure. As a result, there is little wear on the flange 12, permitting preservation of the function of the flange 12 to maintain the axially uniform pressure applied to the rolls 2 and 3 even upon the progression of the wear of the rolls 2 and 3 after long service, thus preventing partial wear of the rolls 2 and 3, and maintaining a desirable interparticle crushing effect.

Figure 3:
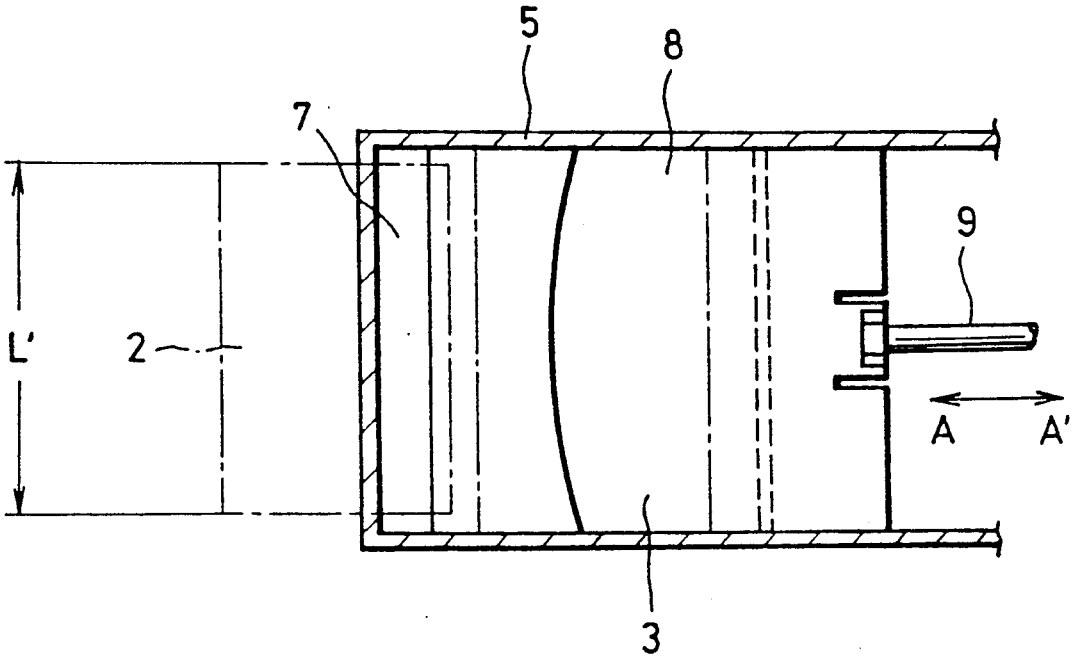
FIG. 3 is a top view of the roll crusher as shown in FIG. 1.

A fixed plate 7 and a slide gate 8 are provided in a supply port 5 of feed material. A rod 9 is connected to the slide gate 8 as shown in FIG. 3. The movement of the rod 9 as shown by Arrow AA' can adjust the spacing between the fixed plate 7 and the slide gate 8, which in turn adjusts the amount of material to be fed into the crushing chamber from the supply port 5. The leading edge of the slide gate 8 is curved so that the section of the supply port 5 is wider in the end portions than the middle portion, which is to compensate short supply of material to the side wall portions of the supply port 5 (that is, both end portions of the crushing chamber 6) due to friction and to supply feed material uniformly over the length of the crushing chamber 6.

Figure 4:
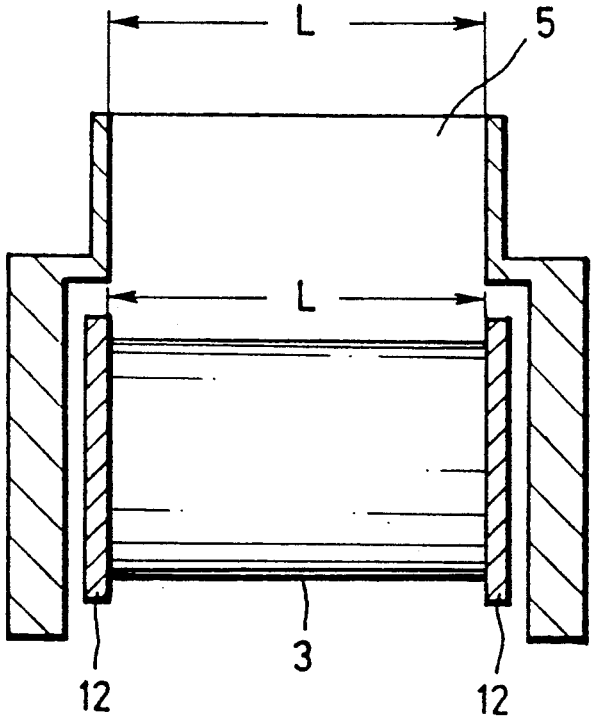
FIG. 4 is a sectional view of FIG. 1 taken along line IV—IV.

The longitudinal length L of the supply port 5, as shown in FIGS. 3 and 4, is designed essentially equal to the spacing between both flanges 12 of the roll 3 and slightly longer than the axial length L' of the roll 2. This, together with the curvature of the leading edge of the slide gate 8 as described above, is to supply feed material uniformly over the length of the rolls 2 and 3.

Sign BE in FIG. 2 is bearings for supporting the rolls 2 and 3.

A roll crusher shown in FIG. 1 uses the less worn flanges 12 to prevent feed material from being pushed out of the crushing chamber 6 in the axial direction of the rolls 2 and 3 by the compression force of the rolls 2 and 3, thus resulting in a uniform distribution of the pressure applied to the rolls 2 and 3 as well as of the compression force of particles of material to be crushed acting on each other, over the whole area of the longitudinal direction (roll axial direction) for a long period of service. As a result, partial wear of the rolls can be prevented for a long time, thus maintaining a desirable interparticle crushing effect.

FIG. 9 shows a driving device to rotationally drive a pair of rolls 2 and 3. The roll 3 on the right side of the drawing is supported on a frame 1 with bearings BE1 and connected to a power drive such as the output shaft of a motor 10 through a coupling 19. The motor 10 drives the roll 3 for counterclockwise rotation in FIG. 1. The roll 2 on the left side of the drawing is supported with bearings BE2 rotatably (can be rotated freely).

In crushing, first one roll 3 is rotated by the motor 10 counterclockwise in the FIG. 1. Then the other roll 2 is rotated clockwise in the drawing through the material being crushed in the crushing chamber 6. As a result, the stock is broken while being rolled up in between the rolls 2 and 3 rotating oppositely to each other. Because the follower roll 2 follows the driving roll 3 and rotates at nearly the same speed as the driving roll 3, crushing is positively performed without any trouble. Here, only one power drive is used for the rolls 2 and 3, thus resulting in a simple configuration of the whole roll crusher, leading to cost reduction.

Incidentally, it is desirable that with a roll crusher the relative positions of the rolls can be varied, that is, the rolls be brought closer to or removed away from each other, in order to adjust particle size of crushed products or to compensate for wear of the rolls 2 and 3 to maintain a constant clearance of the rolls. For this purpose, the bearing BE2 supporting the follower roll 2 according to the invention is so fixed to the frame 1 that the bearing BE2 can be moved as shown by Arrow AA'. In this case, because the roll 2 is rotating freely without any motor or other driving means provided, the movement of the bearing BE2 or the roll 2 is easily made, thus permitting a simple adjustment of crushing clearance of the rolls.

FIG. 10 shows another example of the driving device for the rolls 2 and 3. In this drawing the same members as those shown in FIG. 9 are given by the same numerals.

The follower roll 2 is connected to the driver roll 3 through a gear train 20, which transmits the rotational force of the driver roll 3 to the follower roll 2. The gear train 20 consists of, for instance, four gears 21, 22, 23 and 24 meshing with each other as shown in FIG. 11, and further a one-way clutch 25 is provided between the last gear 24 and the shaft 2*a* of the follower roll 2. The gear train 20 is so designed that the follower roll 2 rotates at a speed at least 5% slower than the driver roll 3. The one-way clutch 25 is installed to transmit the clockwise rotation of the last gear 24 (FIG. 11) to the roll shaft 2*a*, but not to transmit the opposite rotation.

In crushing, first, the motor 10 rotates the driver roll 3 counterclockwise in FIG. 11, at this time the follower roll 2 rotates clockwise at a speed at least 5% slower because of the gear train 20. Supplied in between the rolls 2 and 3 under this condition, the material to be crushed is rolled up in between the rolls 2 and 3 which have started rotation. Once the material is rolled up in between the rolls, the interference of the material increases the rotation speed of the follower roll 2 nearly to that of the driver roll 2, then the one-way clutch 25 functions to allow the free rotation of the follower roll 2 without restriction by the rotation of the last gear 24 or the driver roll 3. At that time, each gear in the gear train 2 racing.

With the embodiment of FIG. 9, because the follower roll 2 does not rotate together with the driver roll 3 at first, it may happen that, when entering feed material includes coarser particles, the coarser particles cannot be nipped, in other words, the effective "nip angle" (the maximum nipping angle which allows crushing in between rolls) becomes smaller. On the contrary, with the embodiment in FIG. 10, in which the follower roll 2 rotates at a lower speed from the beginning, this problem will not occur.

Besides, the gear train 20 is intended only to transmit rotation during a no load or light load condition, and only races during crushing. Therefore, it is not required to transmit large torque and to have much strength, thus reducing additional cost.

As described above, it is desirable that at least one of the rolls 2 and 3 can be moved for adjustment of the crushing clearance of rolls. In the case of FIG. 11, the position of the roll 2 can be shifted by rocking the idle gears 22 and 23 about the roll shaft 3*a* as shown by Arrow EE'.

FIG. 12 shows a further different embodiment for the driving device, in which the follower roll 2 of the embodiment of FIG. 9 is provided with an auxiliary motor 30 for driving. The auxiliary motor 30 can be turned ON or OFF as required by a controller (not shown). Switching the auxiliary motor 30 OFF allows the follower roll 2 to be rotated freely. Alternatively, a clutch can be introduced between the auxiliary motor 30 and the follower roll 2. ON or OFF setting of the clutch can switch the follower roll 2 to be rotated by the auxiliary motor 30 or to be freely rotatable. The rotational speed of the follower roll 2 effected by the auxiliary motor 30 may be the same as that of the driver roll 3 effected by the motor 10. Both speeds are not necessarily the same, but, as in the case of FIG. 10, the follower roll 2 may be driven by the auxiliary motor 30 through a one-way clutch so that the rotational speed of the follower roll 2 is at least 5% slower than that of the driver roll 3.

When the rolls 2 and 3 are rotating under no load or light load, the auxiliary motor 30 is switched ON to rotate the follower roll 2, at which time driving of, the driver roll 3 by the motor 10 has already begun. Under this condition, feed material is supplied in between the rolls 2 and 3, and crushing starts. Once crushing starts, the auxiliary motor 30 is turned OFF, whereupon the follower roll 2 is brought into free rotation or rotation while following the driver roll 3 through material being crushed. Further crushing operation is performed under this condition.

As stated above, under no load or light load, the auxiliary motor 30 is energized to rotate the follower roll 2, but since this rotation does not require large torque, a very inexpensive motor can be used for the auxiliary motor 30, thus contributing no noticeable increase in cost. Therefore, as compared with the case when the rolls are independently driven, cost is lowered.

At the same time, since the follower roll 2 is rotated beforehand under no load, as with the case in the device shown in FIG. 10, coarse particles of feed material can be crushed, in other words, a large effective nip angle can be maintained.

There is another advantageous method for crushing feed material using a roll crusher as follows: According to the method, in FIG. 13, crushing clearance S between the rolls 2 and 3 is adjusted to 0.6–2.4 times 80% passing size of feed material as well as the feed rate is controlled in a range of 0.5 to 0.8 times the theoretical throughput capacity of the crusher. The "passing size" in "80% passing size of feed material" refers to the linear size of the individual square apertures of a sieve for which when a given particle distribution of feed material is put through the sieve, 80% by weight passes through the sieve and the other 20% remains on the sieve. And, the "theoretical passing capacity of crusher" refers to an amount expressed by roll width x roll peripheral speed x crushing clearance of rolls x true specific gravity of feed material.

So far, in crushing rocks or ores by a roll crusher, as shown in FIG. 14, crushing clearance S has been set smaller than the diameter F of feed particles to be crushed and equal to or smaller than the diameter P of particles of desired products. Such narrower crushing clearance S as with the roll crusher according to the prior art limits the throughput capacity, thus resulting in a low productivity of products. Especially, the smaller the desired particle size of products, the narrower the crushing clearance, therefore the more remarkably the productivity falls.

Furthermore, because feed material to be crushed is pressed from both of the right and left directions in the drawing by the rolls 2 and 3, the size and shape of particles are limited as regards only the right and left directions but not for other two directions such as a vertical direction and a perpendicular direction to the paper. As a result, the products may include particles larger than the crushing clearance S, and particles of charateristically flat or slender shape.

On the contrary, according to the invention, the new method forms a spacious crushing chamber by widening the crushing clearance S, which permits multiple layers of stock particles to pass through two opposing rolls, thus resulting in an remarkable increase in throughput capacity. With a wider crushing chamber, much more feed material can be fed into the crushing chamber to cause individual particles to apply pressure onto each other, thus introducing what is called interparticle crushing. This extent of mutual interference generated between particles of feed material is called the interparticle crushing effect. It is the invention that remarkably increases the productivity of a roll crusher and realizes an excellent compressive crushing, by controlling the interparticle crushing effect.

"The control of feed rate so that the throughput of feed material is in a range of 0.5 to 0.8 times the theoretical throughput capacity" is effected to maintain an optimization of aforesaid interparticle crushing effect. By this control, feed material is positively crushed to finer particles than limited by a crushing clearance S, thus resulting in an efficient production or an increased throughput even with finer particles of products. Further, once interparticle crushing takes place, individual particles of feed material are subjected to pressure from every direction for crushing, whereby most of the crushed particles are of desirable, round or cubic shape and few are flat or slender.

If the crushing clearance S should be widened larger than 2.4 times 80% passing size of feed material, the crushing naturally produces a larger throughput capacity, but fails to obtain a sufficient interparticle crushing effect, thus resulting in coarser particles of products, i.e. losing practical crushing. Even though the crushing clearance S is within 0.6 to 2.4 times 80% passing size of feed material, if the feed rate should be so high that the feed rate exceeds 0.8 times the theoretical throughput capacity, the crushing causes the feed material to be overcompacted in the course of compression of the feed material in the crushing chamber (K, L, M and N in FIG. 13), thus resulting not only in overloading but also in grinding rather than crushing and in producing much more fine powder.

Therefore, in order to ensure an adequate interparticle crushing effect and to prevent excessive consolidation, it is indispensable to maintain the crushing clearance S of rolls between 0.6 and 2.4 times 80% passing size of feed material, and to limit the feed rate to such that the throughput ranges from 0.5 to 0.8 times (preferably 0.6 to 0.7) the theoretical throughput capacity.

Crushing experiments were made using the crushing method according to the invention (FIG. 13) and the prior art (FIG. 14). The difference in the effect of both methods is described as follows:

Crushed stone S-5 (5–2.5 mm fraction) of porphyrite was used as feed material to be crushed. The particle size distribution of the material is shown by the curve L in FIG. 15; 20 weight percent contains particles larger than particle size of 4.8 mm, while 80 weight percent smaller. Crushing of the material was made aiming at acceptable products smaller than particle size of 2.1 mm. The particle size distribution of crushed products obtained by the crushing method (FIG. 13) according to the invention is shown by the curves 11 in FIGS. 15 and 16, while one by the crushing method (FIG. 14) according to the prior art is shown by the curves 12 in both Figures. The results are tabulated in Table 1.

TABLE 1

| | Invention | Prior Art |
|---|---|---|
| Roll Clearance S mm | 6.4 | 2.1 |
| Throughput t/Hr | 13.1 | 1.3 |
| Ratio to theoretical capacity | 0.67 | 0.20 |
| Production of particles smaller than 2.1 mm t/Hr | 7.3 | 0.95 |
| Power consumption KW | 18.8 | 4.6 |
| Percentage of absolute volume | 59.8 | 57.5 |

Note: Table includes the results of percentage of absolute volume to evaluate grain shape of manufactured sand based on JIS-A5004, to indicate the difference in grain shapes of products obtained by both methods.

The curves 11 and 12 in FIGS. 15 and 16 verify that the particle size distribution according to the invention and the prior art is essentially similar. But, as shown in Table 1, as regards production rate and power consumption per unit product, the method according to the invention is far better than one according to the prior art. And, based on the percentage of absolute volume for the grain shape evaluation (Table 1) and visual observation of crushed products, the grain shape of products obtained by the method according to the invention is mostly cubical, while products obtained by the method according to the prior art include much more of flat or slender particles.

We claim:

1. A roll crusher for crushing material comprising a pair of rolls facing each other, in which the pair of said rolls rolls feed material therebetween to crush the material, one of the pair of said rolls being a driver roll which is driven for rotation, and another of the pair of rolls being a follower roll, a larger capacity main motor operatively connected to the driver roll for rotating the driver roll, and means for rotating the follower roll when the crusher is under no load and then only a light load before crushing begins, the rotating means comprising a smaller capacity auxiliary motor and means for operatively connecting the auxiliary motor to the follower roll while the crusher is being operated without crushing yet being effected so that the follower roll rotates slower than the driver roll to forcibly entrain said material between said driver roll and said follower roll before crushing begins;

the follower roll being driven by the driver roll at the same speed as the driver roll through material being rolled in between said rolls while crushing is being effected.

2. A roll crusher as claimed in claim 1, wherein the means for operatively connecting the auxiliary motor to the follower roll comprises a one-way clutch for allowing free rotation of the follower roll only in the direction opposite the direction of rotation of the driver roll to permit said driving of the follower roll by the driver roll while crushing is being effected.

3. A crushing method for use in a roll crusher having a pair of rolls facing each other in which neither roll is spring loaded, comprising continuously feeding feed material to be crushed into a crushing chamber formed in between said pair of rolls, rolling said feed material by rotating said pair of rolls in opposite directions to each other to compress and crush said feed material, setting a crushing clearance of said rolls to 0.6 to 2.4 times 80% passing size and maintaining said clearance constant, and limiting a feed rate of the material so that a passing rate of the material ranges from 0.5 to 0.8 times the theoretical throughput capacity of the crusher.

4. A roll crusher for crushing material comprising a pair of rolls facing each other, in which the pair of said rolls rolls feed material therebetween to crush the material, a driver roll, which is one of the pair of said rolls, being driven for rotation, a motor connected to said driver roll for effecting said rotational driving thereof, a follower roll, which is another of the pair of rolls, being driven for rotation when the crusher is under no load and then only a light load before crushing begins by transmission of the rotation of said driver roll to said follower roll, a power transmission means having a gear train transmitting rotation of said driver roll to said follower roll so that the follower roll rotates slower than the driver roll to forcibly entrain said material between said driver roll and said follower roll before crushing begins, and a one-way clutch disposed in between said gear train and said follower roll to transmit rotation from said gear train to said follower roll in a direction only opposite to the direction of rotation of the driver roll but allowing said driver roll to drive the follower roll at the same speed as the driver roll through material being rolled in between said rolls while crushing is effected.

5. A method of operating a roll crusher having a pair of rolls facing each other to form a nip, comprising feeding a material to be crushed to the nip for crushing in the nip, by means of a motor continuously rotationally driving one of the rolls during the feeding and crushing in a direction feeding the material to be crushed into the nip while the other roll is permitted to remain stationary and then by driving means rotationally driving said other roll at a lesser speed than said one roll until the nip is sufficiently fed with the material to be crushed for crushing of said material to begin and for the material being crushed to transmit said continuous rotation of said one roll to effect counter-rotation of said other roll at the same speed as said one roll; and, during the effecting of said counter-rotation by the material being crushed, stopping rotationally driving said other roll by said driving means.

* * * * *